US006694852B1

(12) United States Patent
Ours et al.

(10) Patent No.: US 6,694,852 B1
(45) Date of Patent: Feb. 24, 2004

(54) METHOD AND APPARATUS FOR CUTTING A CASE CONTAINING PRODUCT

(75) Inventors: David C. Ours, Marshall, MI (US); Randall Scherer, Marshall, MI (US); James E. Mabe, Battle Creek, MI (US)

(73) Assignee: Kellogg Company, Battle Creek, MI (US)

( * ) Notice: Subject to any disclaimer, the term of this patent is extended or adjusted under 35 U.S.C. 154(b) by 161 days.

(21) Appl. No.: 09/709,926

(22) Filed: Nov. 10, 2000

(51) Int. Cl.[7] ..... B65B 43/26; B26D 3/00; B26D 7/06

(52) U.S. Cl. ..... 83/861; 83/51; 83/100; 83/152; 83/214; 83/255; 83/404; 53/492; 53/381.2; 414/412

(58) Field of Search ..... 414/412, 414, 414/331, 281; 53/492, 381.2, 382.1, 382.2, 382.3; 83/23, 27, 51, 54, 861, 880, 874, 885, 100, 152, 213, 214, 255, 404, 408, 488, 425.2, 471.2, 856, 946

(56) References Cited

U.S. PATENT DOCUMENTS

| | | | | | |
|---|---|---|---|---|---|
| 2,997,833 | A | * | 8/1961 | Nigrelli et al. | 53/382.1 |
| 3,135,049 | A | * | 6/1964 | Daugherty | 30/2 |
| 3,137,068 | A | * | 6/1964 | Quigley | 30/2 |
| 3,266,541 | A | * | 8/1966 | Kluytenarr et al. | 83/72 |
| 3,457,642 | A | * | 7/1969 | Steer et al. | 30/2 |
| 3,922,778 | A | * | 12/1975 | Aalpoel | 30/2 |
| 3,926,322 | A | * | 12/1975 | Scott | 414/412 |
| 3,937,342 | A | * | 2/1976 | Ittner et al. | 414/411 |
| 5,048,267 | A | * | 9/1991 | Kudo et al. | 53/492 |
| 5,074,097 | A | * | 12/1991 | Hull | 53/381.2 |
| 5,101,703 | A | * | 4/1992 | Tanaka et al. | 83/880 |
| 5,615,993 | A | * | 4/1997 | Tanaka | 414/810 |
| 6,189,298 | B1 | * | 2/2001 | Kuji et al. | 53/492 |

* cited by examiner

*Primary Examiner*—Boyer D. Ashley
(74) *Attorney, Agent, or Firm*—Howard & Howard

(57) ABSTRACT

An apparatus and method for cutting open a case of product having a top and a bottom is provided. The case is placed on a conveyor and moved to a cutting apparatus. The top is cut open at the cutting apparatus. The case is moved to a lift apparatus. The top of the case is opened and the product is lifted from the bottom of the case. The case is then cut thereby separating the bottom of the case from the top of the case.

18 Claims, 6 Drawing Sheets

METHOD AND APPARATUS FOR CUTTING A CASE CONTAINING PRODUCT

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to packaging and, more particularly, to an apparatus and method for cutting open a case of goods.

2. Description of Relating Art

Prepackaged goods to be sold in retail outlets are commonly shipped in large cardboard containers or cases. Each case holds a specific number of the prepackaged goods.

Typically the cases are packed and shipped from the manufacturers' plant to a distribution center. At the distribution center, the cases are opened and the prepackaged goods are prepared for shipping to the retail store. Often, the goods are re-packaged at the distribution center into display cartons for display at the store.

For example, breakfast cereal is typically sold in rectangular boxes to the consumer. The cereal boxes are packaged in large cases at the manufacturer's plant and delivered to distribution centers, where they are prepared for shipping to retail stores, e.g., grocery stores. At the distribution center, the cases are manually opened and the cereal boxes are removed and repackaged into trays for display at the store.

This process is generally inefficient and costly and creates unnecessary waste material. The present invention is aimed at one or more of the problems set forth above.

SUMMARY OF THE INVENTION

In one aspect of the present invention, an apparatus for cutting open a case of product is provided. The case includes a top and a bottom. The apparatus includes a conveyor having a first end and a second end. The conveyor is adapted to move the case from the first end to the second end. The apparatus also includes a top cutting apparatus, a lift apparatus, and a bottom cutting apparatus. The top cutting apparatus includes at least one cutting device and is adapted to cut open the top of the case. The lift apparatus includes first and second arrays of suction cups. The first array of suction cups is adapted to open the top of the case and the second array of suction cups is adapted to lift the product from the bottom of the case. The bottom cutting apparatus includes at least one cutting device and is adapted to cut the case thereby separating the bottom of the case from the top of the case.

In another aspect of the present invention, a method for cutting open a case of product having a top and a bottom is provided. The method includes the steps of placing the case on a first end of a conveyor belt, moving the case to a top cutting apparatus using the conveyor belt, and cutting open the top of the case. The method further includes the steps of moving the case to a lift apparatus using the conveyor, opening the top of the case, lifting the product from the bottom of the case, and cutting the case thereby separating the bottom of the case from the top of the case.

DETAILED DESCRIPTION OF THE PREFERRED EMBODIMENT

With reference to the drawings and in operation, the present invention provides an apparatus and method for cutting open a case of product.

Figure 1:
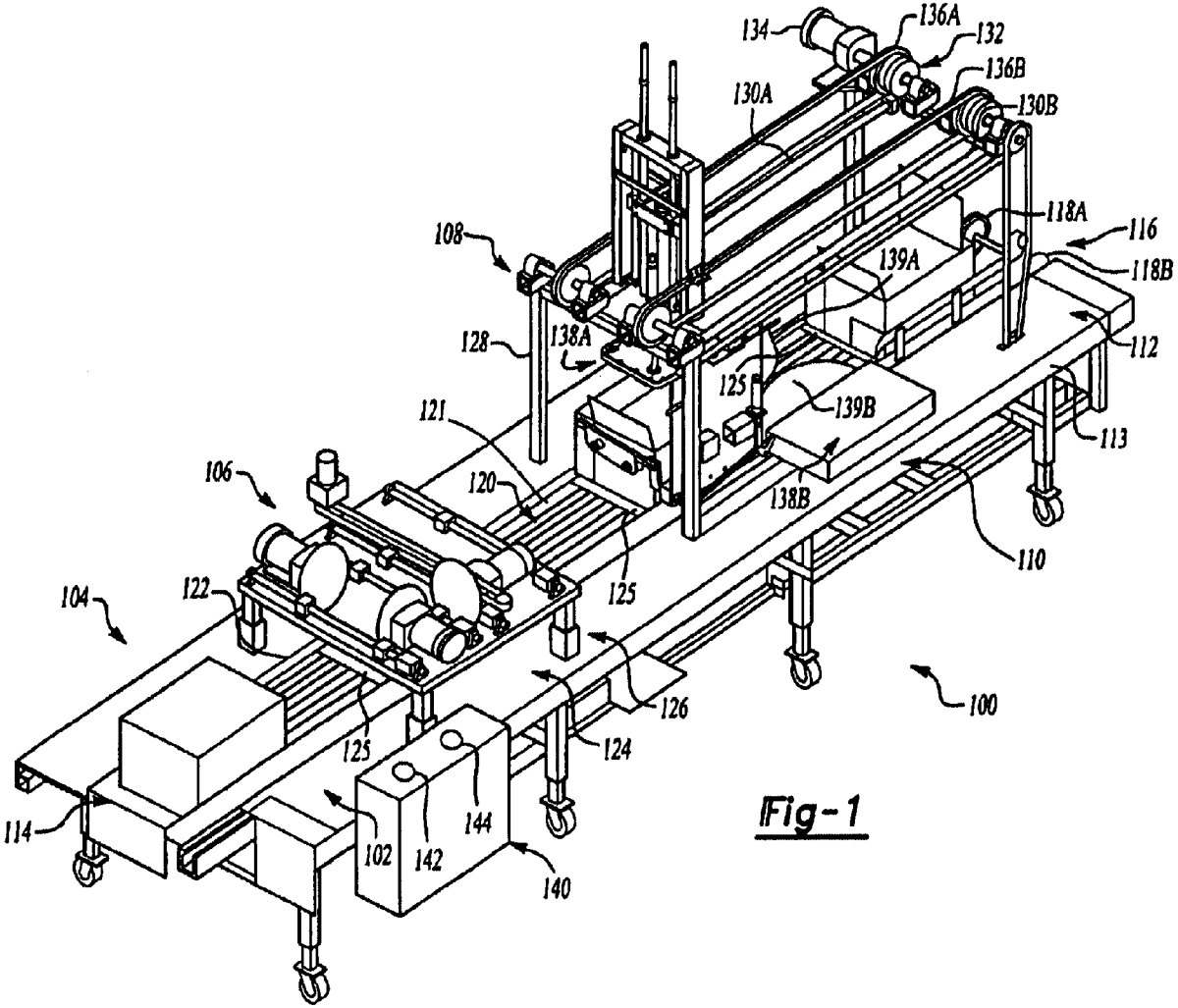
FIG. 1 is an illustration of an apparatus for cutting a case containing product, according to an embodiment of the present invention.

With specific reference to FIG. 1 in one embodiment of the present invention, the case cutting apparatus 100 includes a conveyor 102, a loading station 104, a top cutting apparatus 106, a lift apparatus 108, a bottom cutting apparatus 110 and a removing apparatus 112. The conveyor 102, top cutting apparatus 106, lift apparatus 108, and bottom cutting apparatus 110 are mounted to a frame 113.

Figure 2:
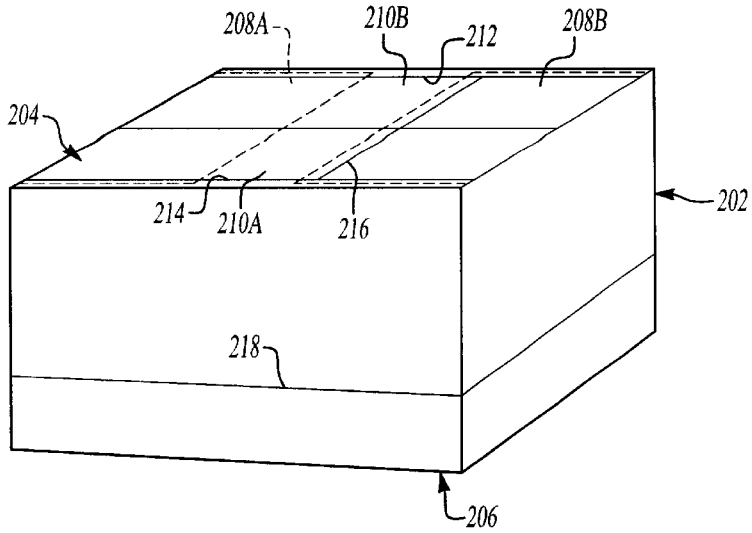
FIG. 2 is an illustration of an exemplary case illustrating a plurality of cuts on the case made by the apparatus of FIG. 1.

With specific reference to FIG. 2, a case 202 has a top 204 and a bottom 206. The top 204 is composed of first and second minor or dust flaps 208A, 208B (shown in dotted lines) and first and second major flaps 210A, 210B. The first and second minor flaps 208A, 208B are folded down below the first and second major flaps 210A, 210B. The case 202 is sealed by glue, tape or other appropriate means.

Returning to FIG. 1, the conveyor 102 has a first end 114 and a second end 116. The conveyor 102 is adapted to move the case 202 from the first end 114 to the second end 116. In the preferred embodiment, the conveyor 102 is a drag conveyor. The drag conveyor 102 has two chains 118A, 118B, one on each side of the conveyor 102. A conveyer surface 120 is composed of a plurality of cross-bars 121. The case 202, as it moves down the conveyor 102, is guided by an adjustable side guide 122 running substantially the length of the conveyor 102 and a plurality of aluminum bars 125, known as flight bars. The aluminum bars 125 are used to position the cases 202 at predetermined intervals along the conveyor 102 and to drag the cases 202 along the conveyer surface 120. A drag conveyor is well known in the art and is therefore not further discussed.

The top cutting apparatus 106 includes at least one cutting device and is adapted to cut open the top 204 of the case 202. In the preferred embodiment, the top cutting apparatus 106 includes a first top cutting apparatus 124 and a second top cutting apparatus 126.

Figure 3:
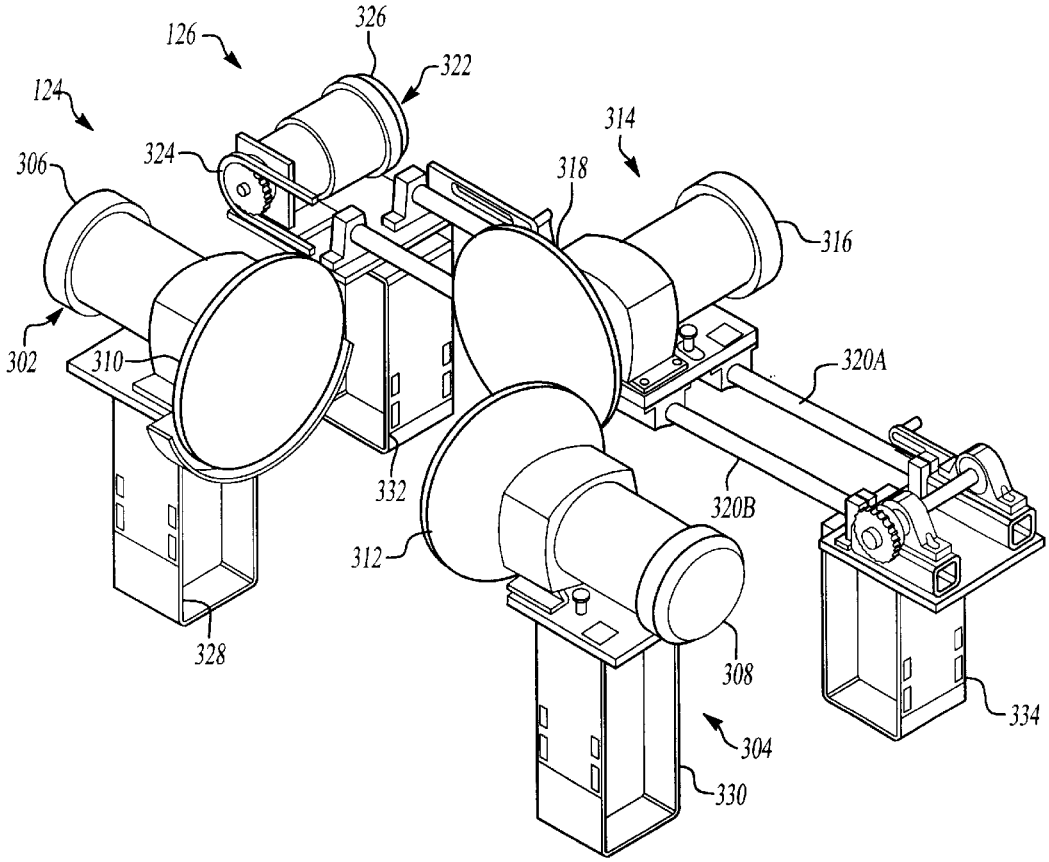
FIG. 3 is an illustration of a top cutting apparatus of the apparatus of FIG. 1, according to an embodiment of the present invention.

With reference to FIG. 3, the first top cutting apparatus 124 includes first and second cutting devices 302, 304 and is adapted to cut the top of the case 202 along first and second opposite sides of the top 204 of the case 202. Preferably, the first and second cutting devices 302, 304 are stationery rotary knives positioned transverse to the top 204 of the case 202, i.e., at an angle relative to the top 204 so as to cut through the major flaps 210A, 210B. Each device 302, 304 includes an electric motor 306, 308 and a rotary blade 310, 312. The cuts in the top 204 of the case 202 are made as the case is drawn past the rotary knives 302, 304 by the conveyor 102.

The second top cutting apparatus 126 includes a third cutting device 314 and is adapted to cut the top 204 of the case between the first and second opposite sides. In the preferred embodiment, the third cutting device 314 is a movable rotary knife positioned transverse to the top 204 of the case 202. The third cutting device 314 includes an electric motor 316 and a rotary blade 318. The third cutting device 314 is mounted on first and second guide bars 320A, 320B. A chain drive system 322 includes a chain 324 and a chain drive motor 326. The chain drive system 322 moves the third cutting device 314 from side to side. In operation, the case 202 is stopped at a predetermined location (see below) and the third cutting device 314 is moved from one side to the other thereby cutting the top 204. The third cutting device 314 is retained at the other side until the next case arrives, at which time the third cutting device 314 motion is reversed, i.e., moved back to the one side.

Referring again to FIG. 2 in the preferred embodiment, the first top cutting apparatus and the second top cutting apparatus 124, 126 are designed to cut the top 204 of the case 202 in a generally "H" shaped pattern defined by first, second and third line segments 212, 214, 216. The "H" shaped pattern of cuts allows the top 204 of the case 202 to be opened (see below).

The cuts indicated by the first and second line segments 212, 214 are made by the first and second cutting devices 302, 304. The cut indicated by the third line segment 216 is made by the third cutting device 314. As shown, the third line segment 216 is generally in the middle section of the top 204, however, it overlaps the minor flap 208A on one side. The third cutting device 314 is adjusted to cut through the major flaps 210A,210B, but not through or only partially through the underlying minor flap 208A. This is to ensure that the product in the case 202 is not damaged.

In one embodiment as shown in FIG. 3, the first and second cutting devices 302, 304 are mounted on manually adjustable first and second mounts 328, 330, respectively. The third cutting device 314 is mounted on first and second side mounts 332, 334. In a second embodiment, the first, second, and third cutting devices 302, 304, 314 are adjustable by four coupled hydraulic lifts (not shown).

Figure 4:
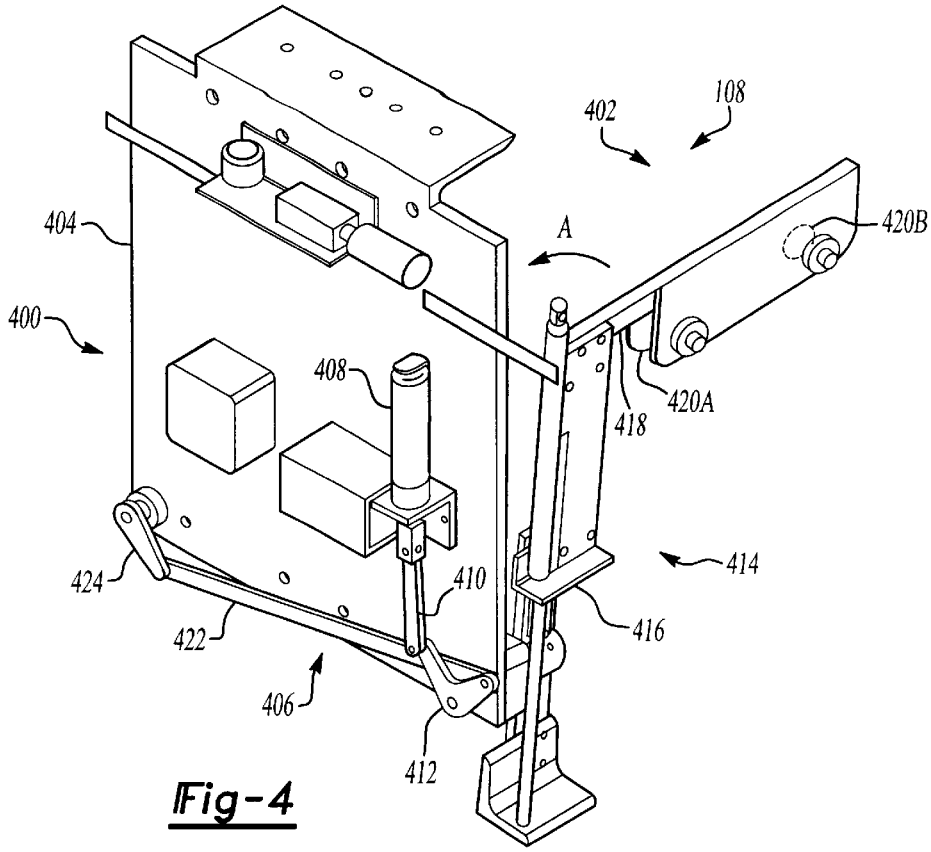
FIG. 4 is an illustration of a portion of a lift apparatus of the apparatus of FIG. 1, according to an embodiment of the present invention.
Figure 5:
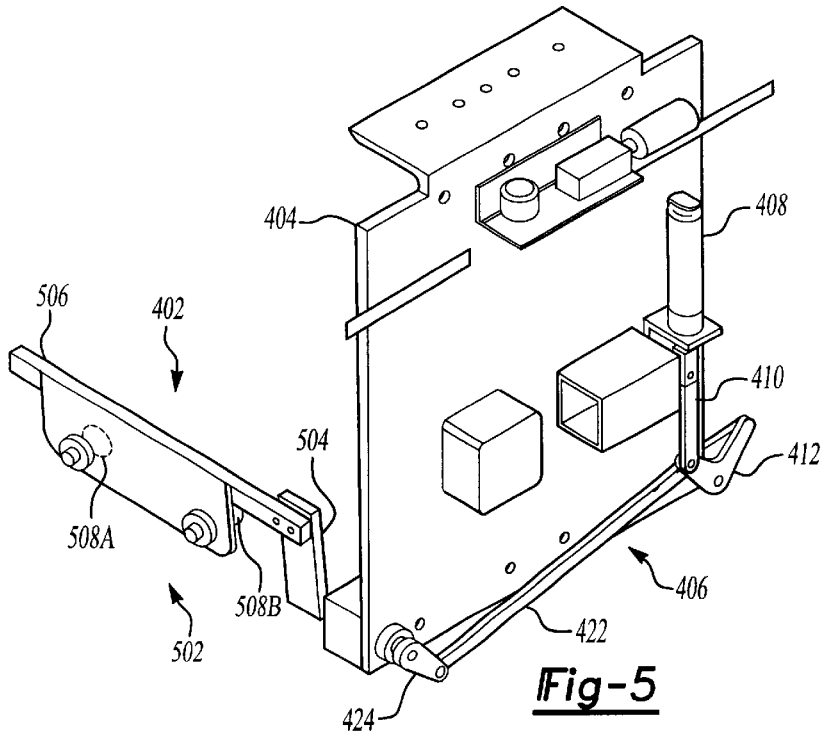
FIG. 5 is an illustration of another portion of the lift apparatus of FIG. 4, according to an embodiment of the present invention.
Figure 6:
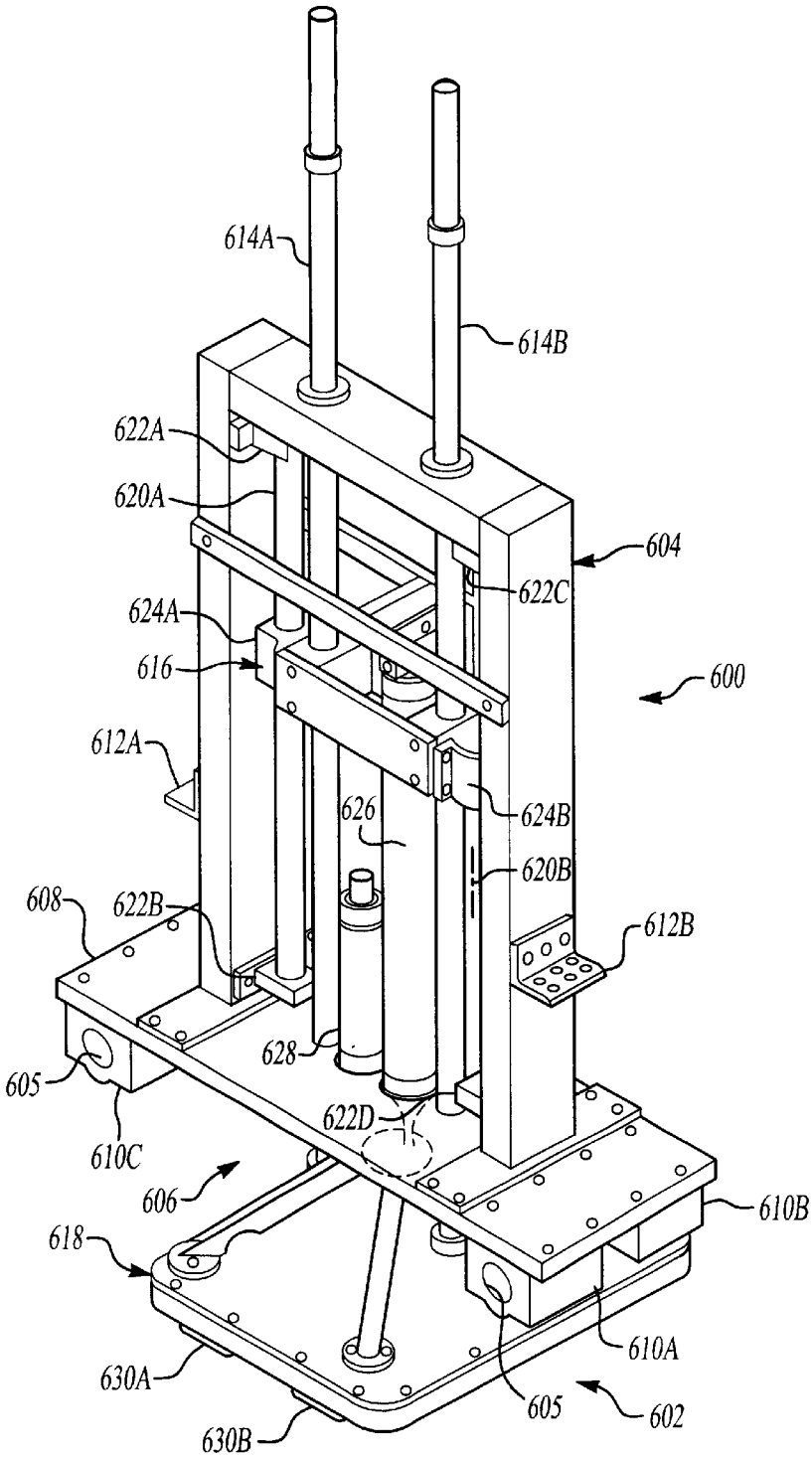
FIG. 6 is an illustration of still another portion of the lift apparatus of FIG. 4, according to an embodiment of the present invention.

With reference to FIGS. 4–6, the lift apparatus 108 includes first and second arrays of suction cups 402, 602. The first array of suction cups 402 is adapted to open the top 204 of the case 202 and the second array of suction cups 602 is adapted to lift the product from the bottom 206 of the case 202.

With specific reference to FIG. 4, the lift apparatus 108 includes a first assembly 400. The first assembly 400 includes an assembly frame 404 mounted to a supporting structure 128 attached to the frame 113. The first assembly 400 includes a linkage assembly 406 coupled to a first actuator 408. In one embodiment, the first actuator 408 is a pneumatic cylinder, but other suitable types of actuators may also be used, e.g., an electronic solenoid.

The linkage assembly 406 includes a first linkage 410 rotatably coupled to the first actuator 408. The first linkage 410 is rotatably coupled to a first end of a v-shaped linkage 412. The v-shaped linkage 412 is coupled to a first opening assembly 414 through the assembly frame 404.

The first opening assembly 414 includes a first arm 416 and a second arm 418. The first arm 416 is adjustable to compensate for different case sizes. The second arm 418 is mounted to the first arm 416. The first array of suction cups 402 is coupled to the second arm 418.

In operation, as the first actuator 408 extends, the first opening assembly 414 rotates in the direction of the arrow A. The first actuator 408 is stopped such that the first array of suction cups 402 is in contact with the top 204 of the case 202. Preferably, there are two suction cups 420A, 420B mounted on the second arm 418.

A pneumatic system (not shown) creates a vacuum through the suction cups 402A, 402B, thereby temporarily coupling the suction cups 402A, 402B with one half of the top 204. Such pneumatic systems are known in the art and are therefore, not further discussed.

Thereafter, the first actuator 408 is contracted rotating the first opening assembly 414 in the reverse direction.

With reference to FIGS. 4 and 5, the linkage assembly 406 includes a connecting linkage 422 rotatably coupled, at one end, to a second end of the v-shaped linkage 412 and to a second linkage 424 at the other end. The second linkage 424 is coupled through the assembly frame 404 to a second opening assembly 502.

The second opening assembly 502 includes a third arm 504 and a fourth arm 506. The third arm 504 is connected to the second linkage 424. The fourth arm 506 is connected to the third arm 504. Preferably the first array of suction cups 402 includes third and fourth suction cups 508A, 508B. The second opening assembly 502 works in conjunction with the first opening assembly 414 by virtue of the connecting linkage 422. The third and fourth suction cups 508A, 508B are also part of the pneumatic system. The second opening assembly 502 operates in a manner similar to the first opening assembly 414.

With reference to FIG. 6 in one embodiment, the lift apparatus 108 includes a carriage assembly 600. The carriage assembly 600 includes an upper carriage assembly 604 and a lower carriage assembly 606. The upper carriage assembly 604 is movably mounted to the supporting structure 128.

The upper carriage assembly 604 includes a platform 608 underneath which are mounted four supporting blocks 610A, 610B, 610C, (only which three are visible. The supporting blocks 610A, 610B, 610C, have apertures through which first and second horizontal guide bars 130A, 130B run (see FIG. 1). The first and second horizontal guide bars 130A, 130B are mounted to the supporting structure 128.

A carriage drive system 132 controllably moves the carriage assembly 600 along the supporting structure 128. The drive system 132 includes an electric motor 134 and a pair of drive chains 136A, 136B. The drive chains 136A, 136B are coupled to a pair of brackets 612A, 612B (see FIG. 6) mounted on the upper carriage assembly 604.

The carriage assembly 600 includes a first and second vertical guide bars 614A, 614B. The first and second vertical guide bars 614A, 614B are slidably coupled to the upper carriage assembly 604. The lower carriage assembly 606 includes an upper support structure 616 and a lower support structure 618. The upper support structure 616 includes two apertures through which the first and second vertical guide 614A, 614B bars run through. The first and second vertical guide bars 614A, 614B also run through two apertures in the platform 608 of the upper carriage assembly 604. The first and second vertical guide bars 614A, 614B are coupled to the lower support structure 618.

Third and fourth vertical guide bars 620A, 620B are mounted to inner surfaces of the upper carriage assembly 604 via brackets 622A, 622B, 622C, 622D. The upper support structure 616 is slidably coupled to the third and fourth vertical guide bars 620A, 620B by brackets 624A, 624B.

A second actuator 626 is coupled between the upper carriage assembly 604 and the lower support structure 618. The second actuator 626 is adapted to controllably move the lower support structure 618 relative to the upper carriage assembly 604.

A third actuator 628 is coupled between the platform 608 and the lower support structure 618. The third actuator is adapted to controllably move the lower support structure 618 relative to the platform 608.

The second array of suction cups 602 includes a plurality of suction cups (only two of which are shown 630A, 630B). The number of suction cups is equal to the number of boxes of product contained in the case 202 (there is only one level of product per case).

The bottom cutting apparatus 110 includes at least one cutting device 138 and is adapted to cut the case 202 thereby separating the bottom 206 of the case 202 from the top 204 of the case 202.

In the preferred embodiment, the bottom cutting apparatus 110 includes first and second bottom cutting devices 138A, 138B. In the preferred embodiment, the first and second bottom cutting devices 138A, 138B are electric-driven rotary knives having a rotary blade 139A, 139B and an electric motor (not shown).

Preferably, the first and second bottom cutting devices 138A, 138B are positioned on opposite sides of the case 202.

Preferably, the rotary blades 139A, 139B are in the same vertical plane relative to the case 202, but are slightly horizontally offset, i.e., the center of one of the rotary blades 139A, 139B is in front of the other relative to the conveyor 102. Additionally, both rotary blades 139A, 139B are slightly over the centerline of the conveyor 102. This arrangement ensures that the case 202 is completely cut through and that the rotary blades 139A, 139A do not interfere with each other.

The first and second bottom cutting devices 138A, 138B are preferably stationery relative to the frame 113. As discussed below, the product within the box is lifted from the bottom 206 of the case 202. The product and the case 202 are then moved along the conveyor 102 past the first and second bottom cutting devices 138A, 138B which cut through the case 202, below the product. The product is then released and allowed to settle back into the case 202.

Figure 7:
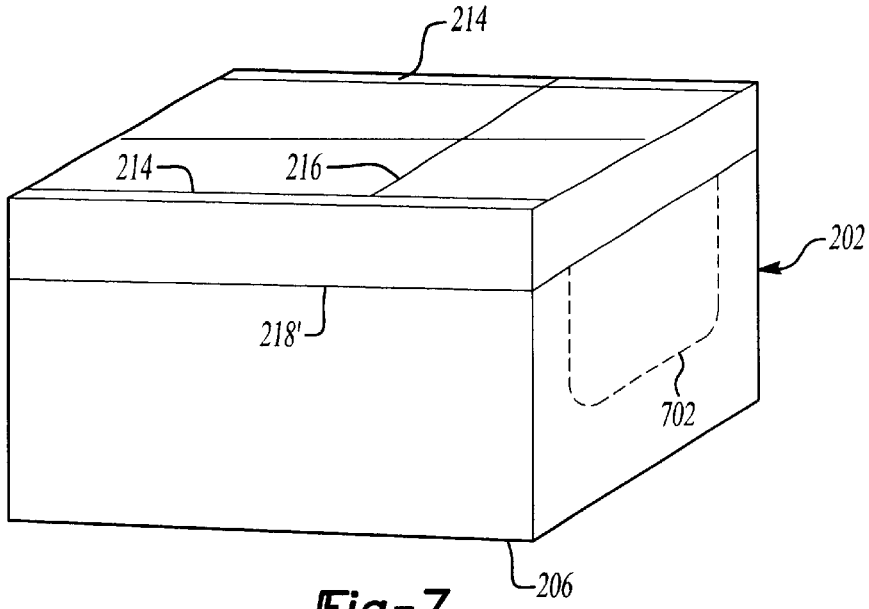
FIG. 7 is an illustration of an exemplary case illustrating the cuts on the case made by the apparatus of FIG. 1, according to a second embodiment.

As shown in FIG. 2 in one embodiment, the bottom cutting apparatus 110 is adapted to cut the case 202 around the sides near the bottom 206, as indicated by line 218. As shown in FIG. 7, the case 202 may include a pre-cut perforated section 702. The perforated section 702 is used to create a display window within a display tray or bottom 206 of the case 202. The bottom cutting apparatus 110 is adjustable such that the bottom 206 is cut from the case above the cutout section 702, as indicated by line 218'.

The apparatus 100 further includes a control system 140. Preferably, the control system 140 includes a programmable logic controller or PLC (not shown). The control system 140 includes relays for turning on and off the electric motors 306, 308, 316 which control the rotary blades 310, 312, 318 and the pneumatic system. The control system 140 further includes a START button 142 and a STOP button 144. The control system 140 may also include switches or buttons (not shown) for starting the electric motors 306, 308, 316 in sequence. Alternatively, the PLC may be programmed to start the electric motors 306, 308, 316 in a predefined sequence. The control system 140 is operably coupled to the top cutting apparatus 106, lift apparatus 108, and bottom cutting apparatus 110 in a conventional manner to control actuation thereof.

Figure 8:
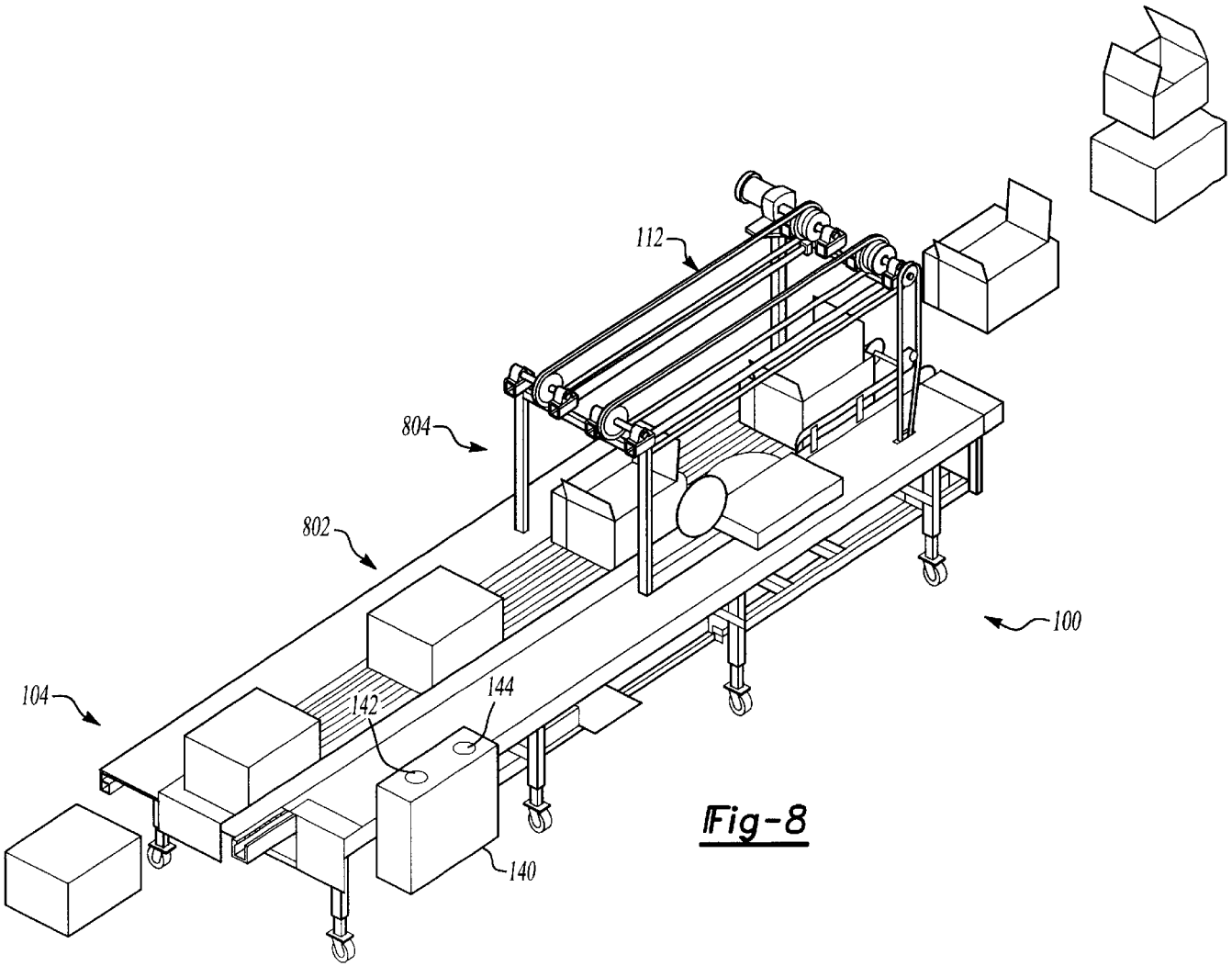
FIG. 8 is a partial view of the apparatus of FIG. 1, according to an embodiment of the present invention.

With reference to FIG. 8, the operation of the apparatus 100 will now be explained. The apparatus 100 will normally be run by two operators (not shown). The apparatus 100 is started by actuation of the START button 142. In response to actuation of the START button 142, the control system 140 starts the electric motors 134, 306, 308, 316, 322, 326. The first operator loads cases 202 unto the conveyor 102 at the first loading station 104.

As discussed below, the apparatus 100 has a number of stations along the conveyer 102 at which the conveyer 102 is stopped. These stations are preferably a preset distance apart, e.g., 60 inches, The aluminum bars 125 are spaced accordingly to ensure that the cases are spaced correctly.

After a case 202 has been loaded onto the conveyor 102, the control system 140 advances the conveyor 102 until the loaded case has reached a second station 802. A sensor (not shown) is mounted below the conveyor 102 and is used to sense when a case 202 has reached the second station 802. Preferably, the sensor detects the aluminum bar 125 behind the loaded case 202. The sensor may be a proximity sensor, photo-detector or other suitable sensor.

The first top cutting device 124 is positioned ahead of the second station 802 such that the top 204 of the case 202 is cut along the sides as discussed above by the first top cutting apparatus 124 as the case 202 moves toward the second station 802.

While the loaded case 202 is stationery at the second station 802, the control system 140 controllably actuates the second top cutting apparatus 126 to cut the top 204 from one side to the other (as discussed above), completing the H-shaped cut pattern.

During this time, the first operator has loaded another case onto the conveyor 102 at the loading station 104.

The control system 140 then moves the conveyor 102 until the first loaded case 202 reaches a third station 804. At the third station 804, the control system 140 controllably actuates the first and second opening assemblies 414, 502 as discussed above to open the case 202, i.e., lift the two cut portions of the top 204. The control system 104 controllably actuates the carriage assembly 600 to controllably lift the product from the bottom of the case. First, the second actuator 626 is extended to lower the lower carriage assembly 606 into position. Then the third actuator 628 is extended to lower the lower support structure 618 so that the second array of suction cups 602 are in contact with the product. The pneumatic system is then actuated so that the product can be lifted. The third actuator 628 is then contracted to lift the product from the bottom of the case 202.

Once this is completed, the conveyor 102 is advanced so that the case 202 is moved to the removal station 112. Simultaneously, the control system 140 actuates the carriage drive system 132 to move the carriage assembly 600 and the product along with the case.

In transit to the removing station 112, the bottom cutting apparatus 110 cuts through the sides of the case 202 separating the top 204 and the bottom 206.

Once the case 202 arrives at the removing station 122, the second operator removes the case 202 from conveyor 102. The top 206 of the case 202 may also be removed.

Each time the conveyor 102 is stopped, the second and third stations 802, 804 contain a case 202. The first operator loads a case 202 onto the conveyor 102 at the loading station 104 and the second operator removes a case 202 from the conveyor 102 at the unloading station 112.

| | |
|---|---|
| 100 | apparatus |
| 102 | conveyor |
| 104 | loading apparatus |
| 106 | top cutting apparatus |
| 108 | lift apparatus |
| 110 | bottom cutting apparatus |
| 112 | removing apparatus |
| 113 | frame |
| 114 | first end of conveyor |
| 116 | second end of conveyor |
| 118 | chain (A, B) |
| 120 | conveyer surface |
| 122 | adjustable guide |
| 124 | first top cutting apparatus |
| 125 | aluminum bar |
| 126 | second top cutting apparatus |
| 128 | supporting structure |
| 130A | first horizontal guide bar |
| 130B | second horizontal guide bar |
| 132 | carriage drive system |
| 134 | electric motor |
| 136 | drive chains (A, B) |
| 138A | first bottom cutting device |
| 138B | second bottom cutting device |
| 140 | control system |
| 142 | START button |
| 144 | STOP button |
| 202 | case |
| 204 | top |
| 206 | bottom |
| 208A | first minor flap |
| 208B | second minor flap |
| 210A | first major flap |
| 210B | second major flap |
| 302 | first cutting device |
| 304 | second cutting device |
| 306 | electric motor |
| 308 | electric motor |
| 310 | rotary blade |
| 312 | rotary blade |
| 314 | third cutting device |
| 316 | electric motor |
| 318 | rotary blade |
| 320A | first guide bar |
| 320B | second guide bar |
| 322 | chain drive system |
| 324 | chain |
| 326 | chain drive motor |
| 328 | first mount |
| 330 | second mount |
| 332 | first side mount |
| 334 | second side mount |
| 400 | first assembly |
| 402 | first array of suction cubs |
| 404 | assembly frame |
| 406 | linkage assembly |
| 408 | first actuator |
| 410 | first linkage |
| 412 | v-shaped linkage |
| 414 | first opening assembly |
| 416 | first arm |
| 418 | second arm |

-continued

| | |
|---|---|
| 420 | suction cup (A, B) |
| 422 | connecting linkage |
| 424 | second linkage |
| 502 | second opening assembly |
| 504 | third arm |
| 506 | fourth arm |
| 508 | suction cups (A, B) |
| 600 | carriage assembly |
| 602 | second array of suction cups |
| 604 | upper carriage assembly |
| 606 | lower carriage assembly |
| 608 | platform |
| 610 | supporting blocks (A, B, C, D) |
| 612 | brackets (A, B) |
| 614A | first vertical guide bar |
| 614B | second vertical guide bar |
| 616 | upper support structure |
| 618 | lower support structure |
| 620A | third vertical guide bar |
| 620B | fourth vertical guide bar |
| 622 | brackets (A, B, C, D) |
| 624 | brackets (A, B) |
| 626 | second actuator |
| 628 | third actuator |
| 630 | suction cups (A, B) |

What is claimed is:

1. An apparatus for cutting open a case of product, the case having a top and a bottom, comprising:

a conveyor having a first end and a second end and being adapted to move the case from the first end to the second end;

a top cutting apparatus having at least one cutting device and being adapted to cut open the top of the case;

a lift apparatus having first and second arrays of suction cups, the first array of suction cups being adapted to open the top of the case and the second array of suction cups being adapted to lift the product from the bottom of the case; and a bottom cutting apparatus having at least one cutting device and being adapted to cut the case thereby separating the bottom of the case from the top of the case after the product has been removed from the bottom of the case, the lift apparatus thereafter returning the product to the bottom of the case.

2. An apparatus, as set forth in claim 1, the top cutting apparatus includes a plurality of cutting devices for cutting the top of the case in a generally "H" shaped pattern.

3. An apparatus, as set forth in claim 1, including a control system for automatically controlling the conveyor, top cutting apparatus, lift apparatus and bottom cutting apparatus.

4. An apparatus, as set forth in claim 3, wherein said control system includes a control box with a start button and a stop button.

5. An apparatus, as set forth in claim 1, wherein the top cutting apparatus includes a pair of stationery rotary knives positioned transverse to the top of the case, the top cutting apparatus being adapted to cut the top of the case along first and second opposite sides of the top of the case.

6. An apparatus, as set forth in claim 5, wherein the top cutting apparatus includes a movable rotary knife positioned transverse to the top of the case, the top cutting apparatus being adapted to cut the top of the case from the first opposite side to the second opposite side.

7. An apparatus, as set forth in claim 1, wherein the bottom cutting apparatus includes first and second bottom cutting rotary knives.

8. An apparatus, as set forth in claim 7, wherein the first and second bottom cutting rotary knives are positioned on opposite sides of the case transverse to sides of the case.

9. An apparatus, as set forth in claim 8, wherein the first bottom cutting rotary knife is horizontally offset from the second bottom cutting rotary knife.

10. An apparatus for cutting open a case of product, the case having a top and a bottom, comprising:

a conveyor having a first and a second end and being adapted to move the case from the first end to the second end;

a first top cutting apparatus having first and second cutting devices and being adapted to cut the top of the case along first and second opposite sides of the top of the case;

a second top cutting apparatus having a third cutting device and being adapted to cut the top of the case between the opposite sides;

a lift apparatus having first and second arrays of suction cups, the first array of suction cups being adapted to open the top of the case and the second array of suction cups being adapted to lift the product from the bottom of the case; and a bottom cutting apparatus having at least one cutting device and being adapted to cut the case thereby separating the bottom of the case from the top of the case after the product has been removed from the bottom of the case, the lift apparatus thereafter returning the product to the bottom of the case.

11. An apparatus, as set forth in claim 10, the top cutting apparatus includes a plurality of cutting devices for cutting the top of the case in a generally "H" shaped pattern.

12. An apparatus, as set forth in claim 10, including a control system for automatically controlling the conveyor, top cutting apparatus, lift apparatus and bottom cutting apparatus.

13. An apparatus, as set forth in claim 12, wherein said control system includes a control box with a start button and a stop button.

14. An apparatus, as set forth in claim 10, wherein the first top cutting apparatus includes a pair of stationery rotary knives positioned transverse to the top of the case, the top cutting apparatus being adapted to cut the top off of the case along first and second opposite sides of the top of the case.

15. An apparatus, as set forth in claim 14, wherein the second top cutting apparatus includes a movable rotary knife positioned transverse to the top of the case, the top cutting apparatus being adapted to cut the top of the case from the first opposite side to the second opposite side.

16. An apparatus, as set forth in claim 10, wherein the bottom cutting apparatus includes first and second bottom cutting rotary knives.

17. An apparatus, as set forth in claim 16, wherein the first and second bottom cutting rotary knives are positioned on opposite sides of the case transverse to sides of the case.

18. An apparatus, as set forth in claim 17, wherein the first and second bottom cutting rotary knives are horizontally offset.

* * * * *